US012595721B1

(12) United States Patent
Austin, II et al.

(10) Patent No.: US 12,595,721 B1
(45) Date of Patent: Apr. 7, 2026

(54) REACTIVE FOIL LINED SHAPED CHARGE

(71) Applicant: Schlumberger Technology Corporation, Sugar Land, TX (US)

(72) Inventors: David Austin, II, Rosharon, TX (US); Hongfa Huang, Rosharon, TX (US); John E. Fuller, Rosharon, TX (US)

(73) Assignee: SCHLUMBERGER TECHNOLOGY CORPORATION., Sugar Land, TX (US)

( * ) Notice: Subject to any disclaimer, the term of this patent is extended or adjusted under 35 U.S.C. 154(b) by 0 days.

(21) Appl. No.: 19/004,683

(22) Filed: Dec. 30, 2024

(51) Int. Cl.
*E21B 43/117* (2006.01)
*E21B 43/116* (2006.01)
*E21B 43/1185* (2006.01)

(52) U.S. Cl.
CPC ..... *E21B 43/117* (2013.01); *E21B 43/116* (2013.01); *E21B 43/1185* (2013.01)

(58) Field of Classification Search
CPC .. E21B 43/116; E21B 43/117; E21B 43/1185; F42B 1/032; F42B 1/02; F42B 3/08
See application file for complete search history.

(56) References Cited

U.S. PATENT DOCUMENTS 4,034,673 A * 7/1977 Schneider, Jr. ..... F42B 12/10 102/476
5,479,860 A * 1/1996 Ellis ..... F42B 1/02 102/202.7
6,925,924 B2 * 8/2005 Baker ..... F42B 1/02 89/1.151
7,752,972 B1 * 7/2010 Baker ..... F42B 1/024 102/476
9,383,176 B2 7/2016 Arguello
2011/0056362 A1 * 3/2011 Yang ..... E21B 43/117 102/307
2011/0094406 A1 * 4/2011 Marya ..... F42B 1/02 102/305
2019/0368318 A1 * 12/2019 Loehken ..... E21B 43/117
2019/0368321 A1 * 12/2019 Eitschberger ..... E21B 23/10
2025/0264308 A1 8/2025 Austin, II
2025/0264309 A1 8/2025 Austin, II
2025/0264310 A1 8/2025 Austin, II

OTHER PUBLICATIONS

"NanoFoil", Retrieved from the internet: https://www.indium.com/products/nanofoil/, Retrieved date: Aug. 11, 2025, 7 Pages.

* cited by examiner

*Primary Examiner* — Yong-Suk (Philip) Ro
(74) *Attorney, Agent, or Firm* — Kyle R. Milller

(57) ABSTRACT

The present disclosure relates to a shaped charge. The shaped charge includes an explosive component and a shaped charge case surrounding an exterior surface of the explosive component. The shaped charge also includes a liner member coupled to the explosive component. The explosive component and the liner member are configured to form a perforating jet based on detonation of the explosive component. The shaped charge also includes one or more reactive foils coupled to the explosive component and configured to initiate the explosive component.

19 Claims, 11 Drawing Sheets

REACTIVE FOIL LINED SHAPED CHARGE

BACKGROUND

The present disclosure generally relates to systems and methods for initiating shaped charges.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admission of prior art.

Exploring, drilling, and completing hydrocarbon and other wells are generally complicated, time consuming and ultimately very expensive endeavors. As a result, over the years, well architecture has become more sophisticated where appropriate in order to help enhance access to underground hydrocarbon reserves. For example, as opposed to wells of limited depth, it is not uncommon to find hydrocarbon wells exceeding 30,000 feet in depth. Furthermore, as opposed to remaining entirely vertical, today's hydrocarbon wells often include deviated or horizontal sections aimed at targeting particular underground reserves.

While such well depths and architecture may increase the likelihood of accessing underground hydrocarbon reservoirs, other challenges are presented in terms of well management and the maximization of hydrocarbon recovery from such wells. For example, during the life of a well, a variety of well access applications may be performed within the well with a host of different tools or measurement devices. However, providing downhole access to wells of such challenging architecture may require more than simply dropping a wireline into the well with the applicable tool located at the end thereof. Indeed, a variety of isolating, perforating, and stimulating applications may be employed in conjunction with completions operations.

In the case of perforating, different zones of the well may be outfitted with packers and other hardware, in part for sake of zonal isolation. Thus, wireline or other conveyance may be directed to a given zone and a perforating gun employed to create perforation tunnels through the well casing. Specifically, shaped charges housed within a steel gun may be detonated to form perforations or tunnels into the surrounding formation, ultimately enhancing recovery therefrom.

The profile, depth, and other characteristics of the perforations are dependent upon a variety of factors in addition to the material structure through which each perforation penetrates. That is, the jet formed by the detonation of a given shaped charge may pierce a steel casing, cement, and a variety of different types of rock that make up the surrounding formation. However, characteristics of different components of the shaped charge itself may determine the characteristics of the jet, and ultimately the depth, profile, and overall effectiveness of each given perforation as described herein.

Among other components, a shaped charge generally includes a case, explosive pellet material, and a liner member. Thus, detonation of the explosive within the case may be utilized to direct the liner away from the gun and toward the well wall as a means by which to form the noted jet. Therefore, the characteristics of the jet are largely dependent upon the behavior of the liner and other shaped charge components upon detonation. For example, a solid copper or zinc liner may be utilized to generate a jet of considerable stretch with a head or tip that travels at 5-10 times the rate of speed as compared to the speed at the tail. Depending on the casing thickness, formation type, and other such well-dependent characteristics, this type of liner is generally of notable effectiveness in terms of achieving substantial depth of penetration.

BRIEF DESCRIPTION

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, the present disclosure is directed to a shaped charge. The shaped charge includes an explosive component and a shaped charge case surrounding an exterior surface of the explosive component. The shaped charge also includes a liner member coupled to the explosive component. The explosive component and the liner member are configured to form a perforating jet based on detonation of the explosive component. The shaped charge also includes one or more reactive foils coupled to the explosive component and configured to initiate the explosive component.

In one embodiment, the present disclosure is directed to a shaped charge. The shaped charge includes an explosive component and a shaped charge case surrounding an exterior surface of the explosive component. The shaped charge also includes a liner member coupled to the explosive component. The explosive component and the liner member are configured to form a perforating jet based on detonation of the explosive component. The shaped charge also includes a primary reactive foil positioned at an apex of the explosive component and configured to initiate the explosive component. Further, the shaped charge includes one or more additional reactive foils separate from the primary reactive foil. Further still, the shaped charge includes a reactive foil initiation subsystem configured to trigger the initiation of the explosive component by the primary reactive foil and the one or more additional reactive foils.

In one embodiment, the present disclosure is directed to a method. The method includes providing a shaped charge case. The method also includes providing one or more reactive foils within the casing. Further, the method includes providing an explosive material into the shaped charge case and coupling the explosive material to the one or more reactive foils. Further still, the method includes assembling a reactive lined shaped charge based on the explosive material being provided into the shaped charge case and coupled to the one or more reactive foils.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
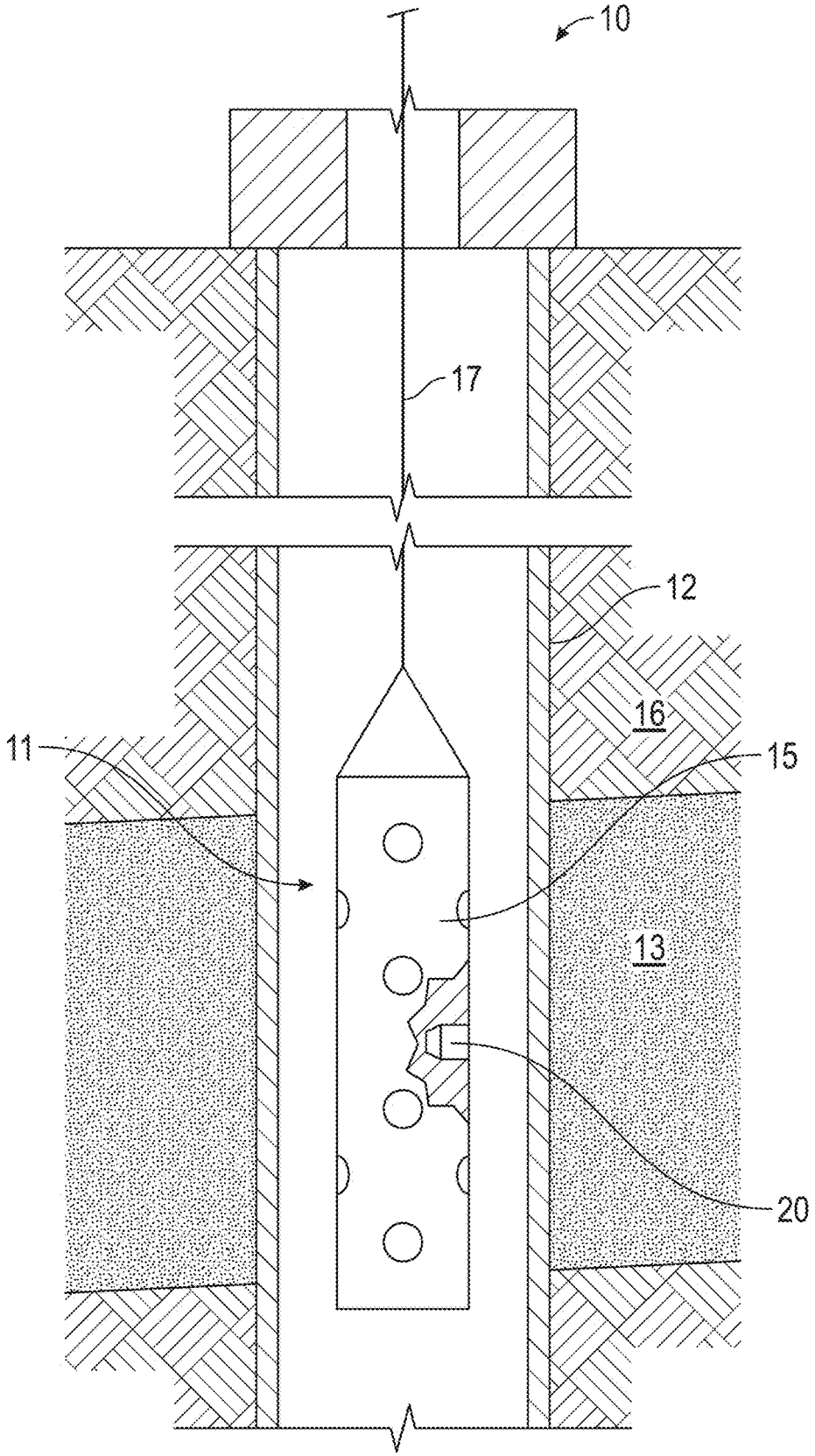
FIG. 1 shows a perforation operation, in accordance with aspects of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

In addition, as used herein, the terms "real time", "real-time", or "substantially real time" may be used interchangeably and are intended to describe operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "automatic" and "automated" are intended to describe operations that are performed or caused to be performed, for example, by a processing system (i.e., solely by the processing system, without human intervention). In addition, as used herein, the term "approximately equal to" or "substantially" may be used to mean values that are relatively close to each other or within a particular range (e.g., within 5%, within 2%, within 1%, within 0.5%, or even closer, of each other).

The initiating mechanism (e.g., detonation initiation mechanism) of conventional shaped charges may include a ballistic train. For example, to start the ballistic train, a detonator may be electronically triggered, which detonates the high explosive contained therein, producing a shock wave. The shock wave propagates through the detonator and then transferred to a detonating cord that, at least in some instances, is through direct contact. In some embodiments, additional explosive components may be utilized to bridge a physical gap (e.g., a donor and receptor booster). In any case, the detonating cord communicates a shock wave to each individual charge of the shaped charge. There may be a cavity on one side (e.g., the back) of the shaped charge with a readily initiable primer explosive that is used to then communicate this shock wave to the main explosive load (e.g., the explosive component) and, ultimately, produce a jet. The primer of the shaped charge may be sealed by a thin foil barrier.

Good physical contact between components may facilitate expected operation of the ballistic train. This may involve utilizing multiple elements that may each add considerable expense to the overall shaped charge. These components also complicate the logistics of field operations and manufacturing (e.g., may utilize difficult and/or costly services associated with transport, sale, and handling of additional explosive elements.) Further, to reliably communicate a shock front from the detonating cord to the shaped charge, each charge may have a relatively large hole (e.g., about 0.1 to 0.2 inches in diameter) that houses the primer explosive. This hole may represent a loss of tamping mass and an escape port for pressure produced during the detonation reaction, which serves to reduce jet velocity and overall charge performance. The jet tip speed of the shaped charge could be improved by approximately 5-10% if this feature is not present or substantially reduced in size.

Accordingly, the present disclosure relates to a reactive foil lined shaped charge that includes an initiating mechanism that may avoid the use of ballistic initiation schemes and, thus, reduce or eliminate the hole currently present in conventional shaped charges. The disclosed initiating mechanism includes one or more reactive foils (e.g., a reactive film, a reactive multi-layer foil) that are coupled to an explosive component. In some instances, the disclosed reactive foils may be deposited on, or otherwise provided onto one or more surfaces of the reactive foil lined shaped charge, such as between the explosive component and a liner member, between the explosive component and a shaped charge case, embedded within the explosive component, or a combination thereof. The reactive foil includes one or more materials that are capable of undergoing an exothermic reaction (e.g., a self-sustaining reaction) to initiate the explosive component. Because the explosive component may be initiated (e.g., detonated) with the reactive foil, a hole or recess typically present in conventional shaped charges that may result in a pressure loss can be substantially eliminated. As such, the shaped charge case of the reactive foil lined shaped charge may be substantially solid as it extends away from the explosive component. In some embodiments, the reactive foil may be detonated wirelessly or using a wiring scheme. It is presently recognized that forming shaped charges with a reactive foil on one or more interior surfaces may reduce total cost to operate a perforating gun on a per shot basis, particularly in the unconventional market.

Further, it is also recognized that using the disclosed reactive foil may provide the possibility of additional optimization, allowing for placement of the initiation site in places not previously possible in conventional shaped charges (e.g. further away from the apex up to and including at the extreme of propagating from skirt to apex) and from multiple points simultaneously (e.g. at multiple uniformly positioned points on a plane which is normal to the direction of the jet travel, and even potentially in the extreme where sufficient coverage exists to uniformly initiate the entire surface of the charge-case explosive interface). Further still, using the disclosed reactive foil may also eliminate the hole on the back of each charge and some or all of the primer and, thus, the reactive foil may provide a more readily initiable material that can be excited by communication of ballistic shock from the detonating cord through the case.

With reference to FIG. 1, after a well 10 is drilled, a casing 12 is typically run in the well 10 and cemented to the well 10 in order to maintain well integrity. After the casing 12 has been cemented in the well 10, one or more sections of the casing 12 that are adjacent to the formation zones of interest (e.g., target well zone 13) may be perforated to allow fluid from the formation zones to flow into the well for production to the surface or to allow injection fluids to be applied into the formation zones. To perforate a casing section, a perforating gun string may be lowered into the well 10 to a desired depth (e.g., at target zone 13), and one or more perforation guns 15 may be fired to create openings in the casing 12 and to extend perforations into the surrounding formation 16. Production fluids in the perforated formation 16 can then flow through the perforations and the casing openings into the wellbore 11.

Typically, perforating guns 15 (which include gun carriers and shaped charges mounted on or in the gun carriers or, alternatively, include sealed capsule charges) are lowered through tubing or other pipes to the desired formation interval on a line 17 (e.g., wireline, e-line, slickline, coiled tubing, and so forth). The charges carried in a perforating gun 15 may be phased to fire in multiple directions around the circumference of the wellbore 11. Alternatively, the charges may be aligned in a straight line. When fired, the charges create perforating jets that form holes in the surrounding casing 12 as well as extend perforation tunnels into the surrounding formation 16.

With reference to FIG. 1, certain embodiments of the present disclosure include a perforation system comprising: (1) a perforating gun 15 (or gun string), wherein each gun may be a carrier gun (as shown) or a capsule gun (not shown); and (2) one or more improved shaped charges 20 loaded into the perforating gun 15 (or into each gun of the gun string), each charge having a liner member, as described herein; and (3) a conveyance mechanism 17 for deploying the perforating gun 15 (or gun string) into a wellbore 11 to align at least one of said shaped charges 20 within a target formation interval 13, wherein the conveyance mechanism may be a wireline, tubing, or other conventional perforating deployment structure; among other components.

Figure 4:
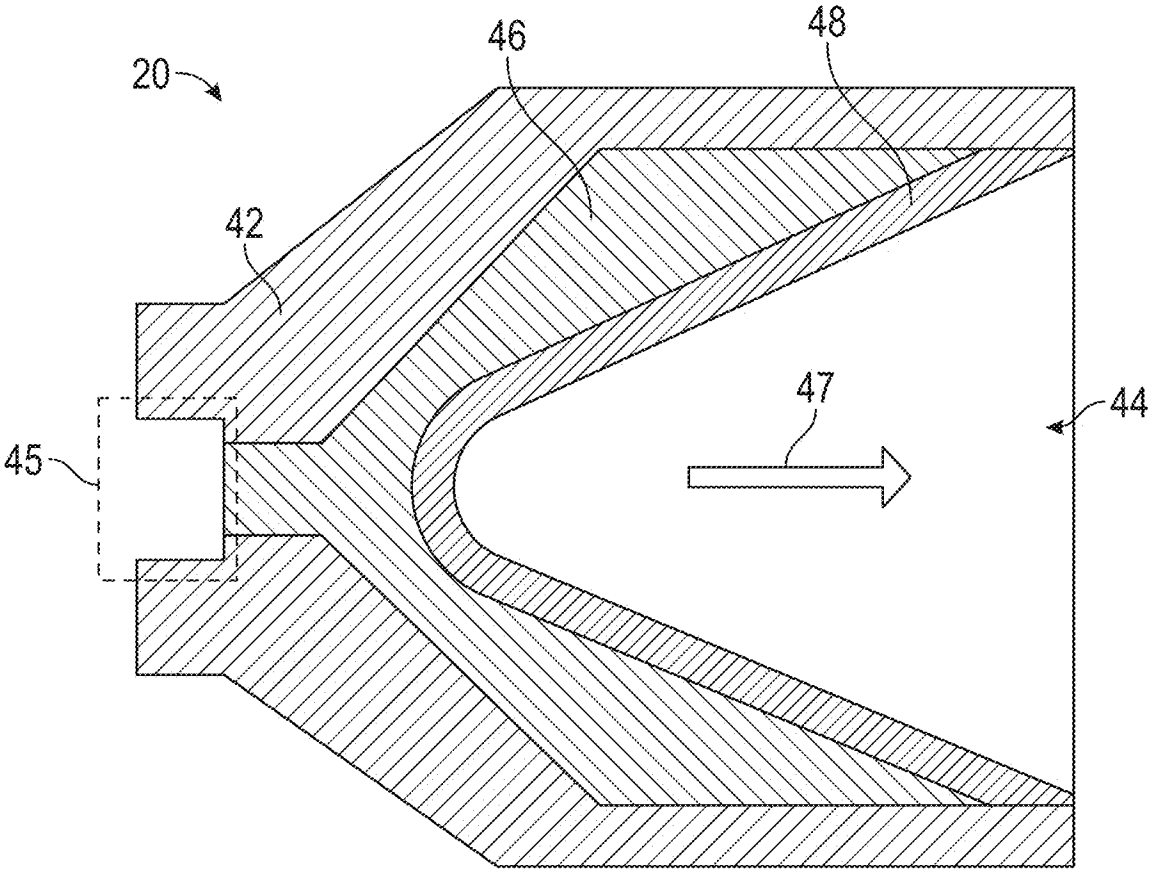
FIG. 4 shows a cross-sectional view of an embodiment of a shaped charge, in accordance with aspects of the present disclosure.

Examples of explosives (e.g., explosive materials that may be used to form the explosive component as described in FIG. 4) that may be used in the various explosive components (e.g., charges, detonating cord, and boosters) include RDX (cyclotrimethylenetrinitramine or hexahydro-1,3,5-trinitro-1,3,5-triazine), HMX (cyclotetramethylenetetranitramine or octanhydro-1,3,5,7-tetranitro-1,3,5,7-tetrazoncine), TATB (triaminotrinitrobenzene), HNS (hexanitrostilbene), and others.

Figure 2:
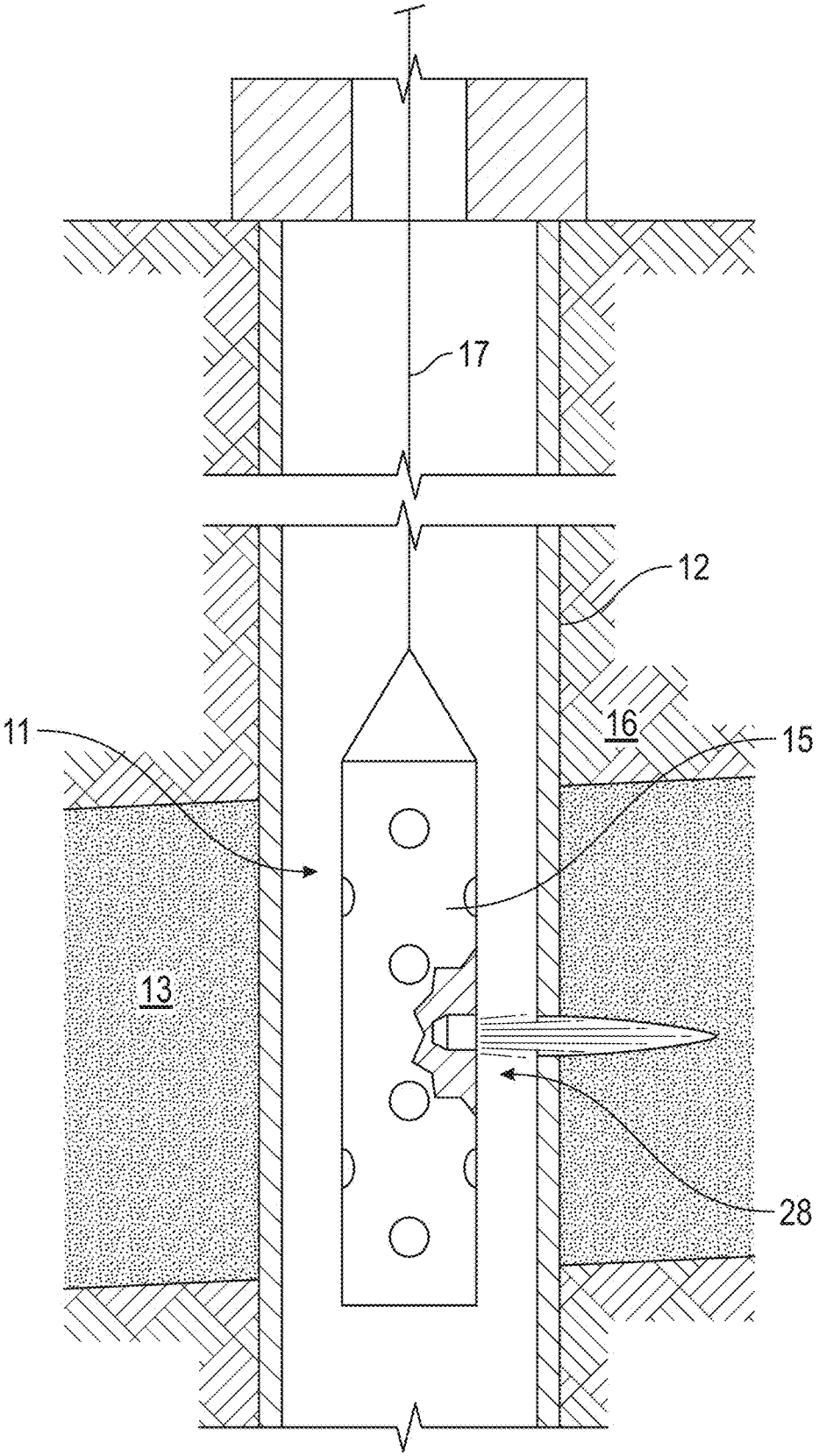
FIG. 2 shows a diagram illustrating a perforation being made with a perforation gun, in accordance with aspects of the present disclosure.
Figure 3:
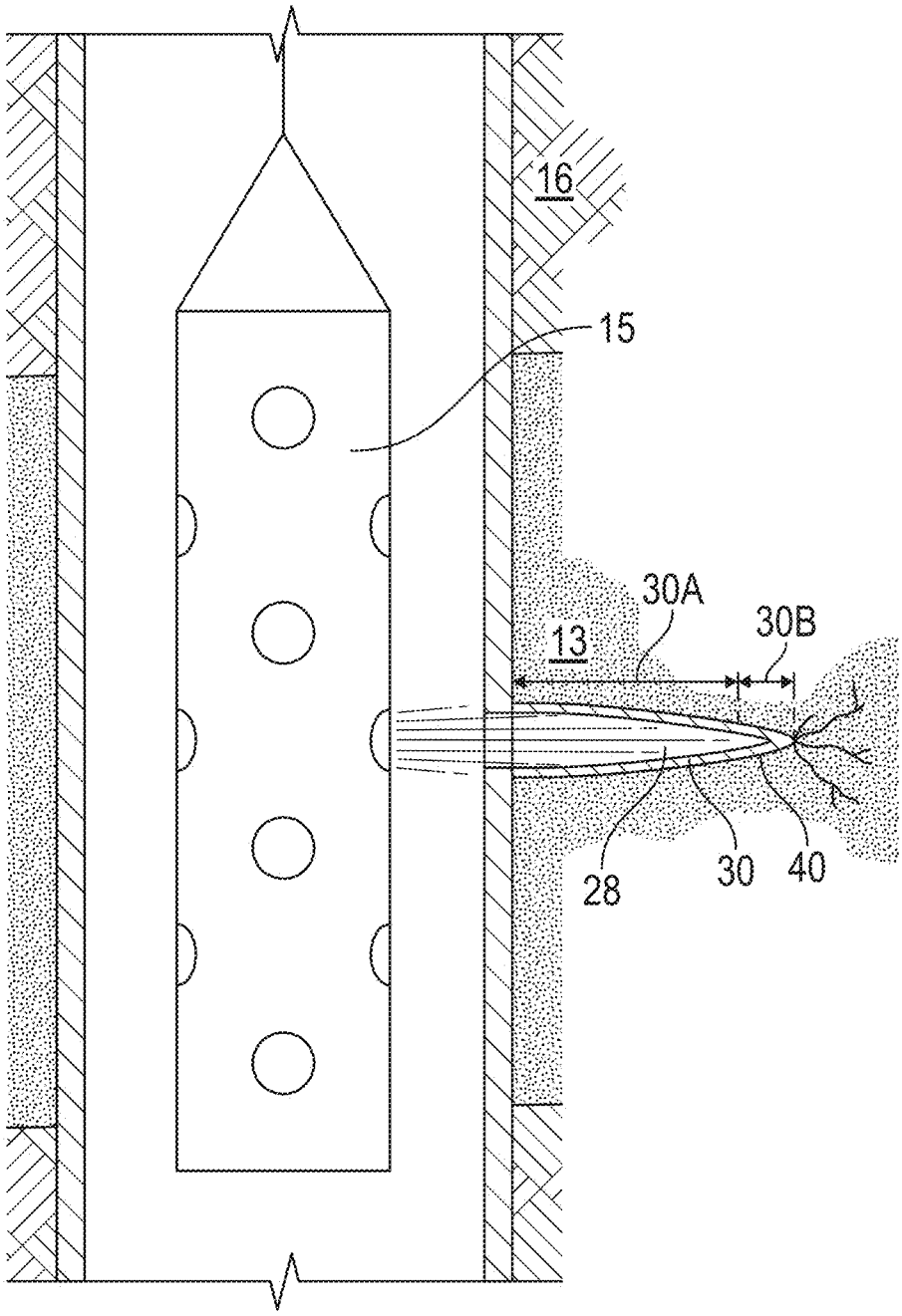
FIG. 3 shows a diagram illustrating a perforation and a tunnel made with a shaped charge, in accordance with aspects of the present disclosure.

Referring to FIGS. 2 and 3 (e.g., FIG. 2 and FIG. 3), the material from a collapsed liner of the shaped charge 20 (e.g., as described in more detail in FIG. 4) forms a perforating jet 28 that shoots through the front of the shaped charge and penetrates the casing 12 and underlying formation 16 to form a perforated tunnel (or perforation tunnel) 40. Around the surface region adjacent to the perforated tunnel 40, a layer of residue 30 from the charge liner is deposited. The charge liner residue 30 includes "wall" residue 30A deposited on the wall of the perforating tunnel 40 and "tip" residue 30B deposited at the tip of the perforating tunnel 40. As described in more detail with respect to FIG. 5, adjusting properties of the shaped charge 20 (e.g., the geometry of the liner, the density of the liner, the mechanical strength of the liner, and so on) may adjust jet properties (e.g., jet velocity and/or jet shape) of the perforating jet 28.

Referring now to FIG. 4, a cross sectional view of an embodiment of a shaped charge 20 is shown. The shaped charge 20 includes a shaped charge case member 42 (e.g., a shaped charge case) and an interior volume 44 that is defined by an explosive component 46 and a liner member 48. The explosive component 46 is disposed between the shaped charge case member 42 and the liner member 48 such that the liner member 48 surrounds the interior volume 44.

The liner member 48 may be formed of packed, powdered metals and, in at least some instances, non-metallic materials. The metals of the liner member 48 may include metals having a density of approximately 6 or greater grams per cubic centimeter (g/cc), 7 or greater g/cc, 8 or greater g/cc, 9 or greater g/cc, 10 or greater g/cc, 11 or greater g/cc, 12 or greater g/cc, or 13 or greater g/cc, and so on. In some embodiments, the metals of the liner member 48 may include metals having a density less than approximately 6 g/cc (e.g., aluminum, beryllium, titanium, and so on). For example, the liner member 48 may include copper (e.g., having a density of approximately 8.9 g/cc) and/or lead (e.g., having a density of approximately 11.3 g/cc). In some embodiments, the liner member 48 may include tungsten (e.g., having a density of approximately 19.3 g/cc). In some embodiments, the liner member 48 may include a mixture of metals, which may provide a desired density. For example, the liner member 48 may include approximately 50 weight percent (wt %) or greater, approximately 60 wt % or greater, approximately 70 wt % or greater, approximately 80 wt % or greater, or approximately 90 wt % or greater of a first metal (e.g., tungsten). Further, the liner member 48 may include a remaining wt % of a second metal (e.g., copper or lead), such as approximately 10 wt % or less, 20 wt % or less, 30 wt % or less, and so on.

As mentioned above, the liner member 48 may also include non-metallic materials, such as nitrides, carbides, oxides, diamond, ceramic materials, or a combination thereof. For example, the liner member 48 may include relatively low-density materials (e.g., as compared to the metals), such as SiC, $Si_3N_4$, $SiO_2$, $B_4C$, $B_4N$, ZnO, TiC, $Li_3N$, $TiO_2$, $Mg_3N_2$, and other relatively low-density non-metallic materials. In some embodiments, the liner member 48 may include a polymer material, such as fluorinated polymers (e.g., polytetrafluoroethylene). In some embodiments, the liner member 48 may include metal-polymer composite mixtures. In such embodiments, the liner member 48 may include a first weight percent (wt %) (e.g., first amount) of one or more metals and a second wt % of one or more non-metallic materials. For example, the liner member 48 may include approximately 50 wt % or greater, 60 wt % or greater, 70 wt % or greater, 80 wt % or greater, 90 wt % or greater of one or more metals. As such, the liner member 48 may include approximately 50 wt % or less, 40 wt % or less, 30 wt % or less, 20 wt % or less, or 10 wt % or less of one or more non-metallic materials.

In operation, the explosive component 46 may be initiated using an initiation source (not shown) that is positioned in the recess 45. Accordingly, initiation by the source may cause a jet to propagate in the direction 47. Examples of jets are described in more detail below.

Figures 5A, 5B, 5C:
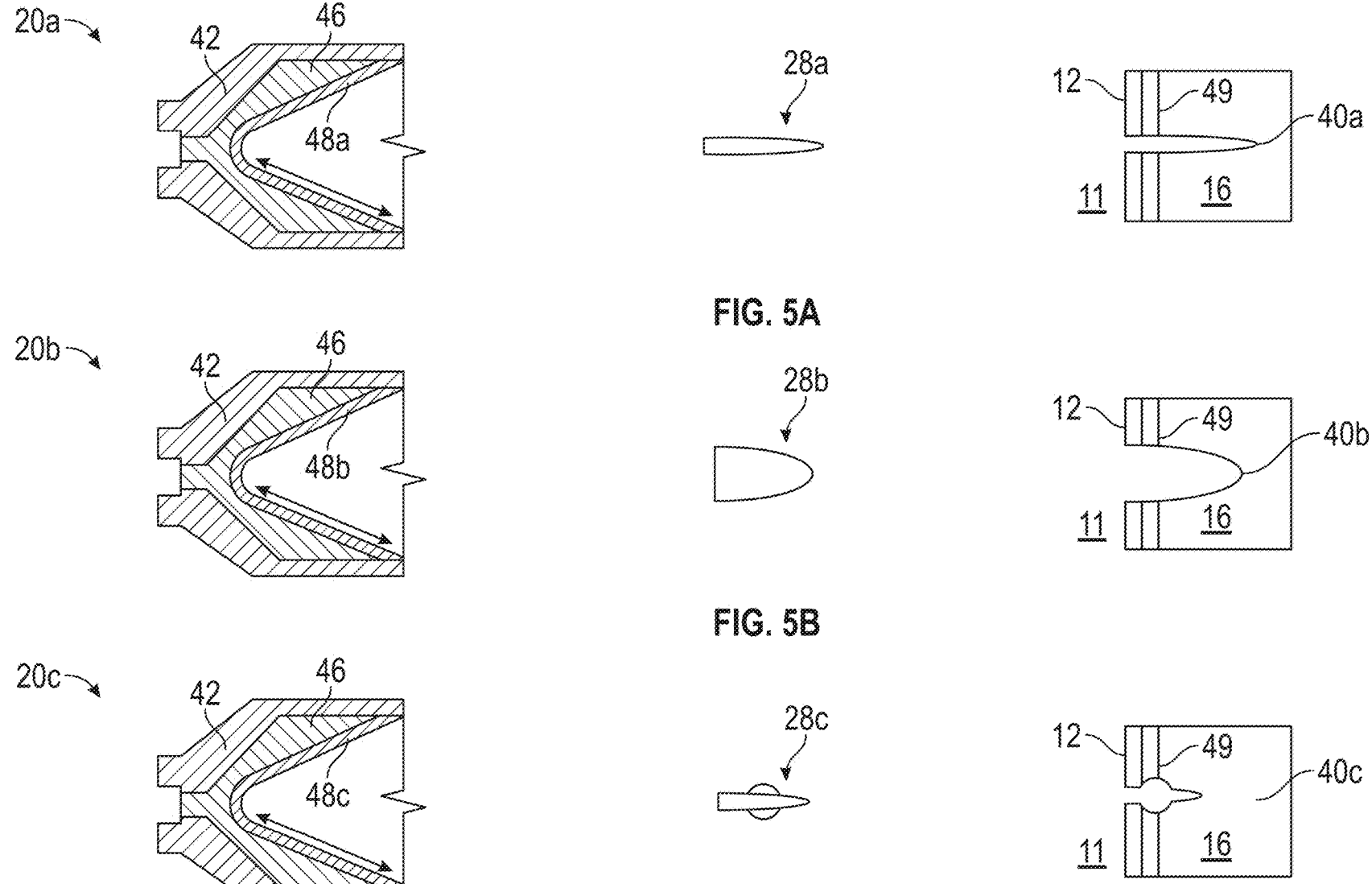
FIG. 5A shows a diagram of the shaped charge of FIG. 4 forming a first type of jet, in accordance with aspects of the present disclosure.
FIG. 5B shows a diagram of the shaped charge of FIG. 4 forming a second type of jet, in accordance with aspects of the present disclosure.
FIG. 5C shows a diagram of the shaped charge of FIG. 4 forming a third type of jet, in accordance with aspects of the present disclosure.

Referring specifically now to FIGS. 5A, 5B, and 5C (e.g., collectively FIGS. 5A-5C), side cross-sectional views of a different types of shaped charges 20*a*, 20*b*, and 20*c* in use during perforating applications are shown. That is, in each case, a charge 20*a*, 20*b*, and 20*c* has been loaded into a perforating gun (not shown), and utilized in a perforating application in a well 10. The charges 20*a*, 20*b*, and 20*c* may be made up of generally the same features described with respect to FIG. 1. For example, the charges 20*a*, 20*b*, and 20*c* may include the same type of shaped charge case member and explosive component 46. However, in each case, a different type of liner member 48*a*, 48*b*, and 48*c* may be used to provide a different type of charge 20*a*, 20*b*, and 20*c* for a different type of perforating application.

With reference to FIG. 5A in particular, a deep penetrating jet shaped charge 20*a* is shown. Upon detonation, a deep penetrating jet 28*a* is formed and directed at the casing 12 that defines the well 10. Ultimately, this forms a perforation tunnel 40*a* that penetrates through the shaped charge case member 42, cement 49, and into the adjacent formation 16 so as to aid in hydrocarbon recovery therefrom. In the embodiment shown, the liner member 48*a* that is used to form the jet 28*a* and achieve such penetration may be a comparatively thin but high-density tungsten-based liner member 48*a* so as to form a thinner and longer jet 28*a*. The end result, depending largely on the particular characteristics of the casing 12, may be a deep perforation tunnel 40*a*.

Of course, as depicted in the embodiment of FIG. 5B, a different type of liner member 48*b* may be utilized to obtain a different type of charge 20*b* and performance during perforation. More specifically, in the embodiment of FIG. 5B, a side cross-sectional view of wide jet shaped charge 20*b* is shown. In this case, the liner member 48*b* is of a comparatively thicker dimensions and lower density, perhaps with a lower percentage of tungsten. Thus, a comparatively thicker or wider jet 28*b* may be formed. The end result, again depending on characteristics of the casing 12 and other physical factors, may be a shorter perforation tunnel 40*b*.

Referring now to FIG. 5C, a side cross-sectional view of a combination jet shaped charge 20*c* is shown. In this case, the liner member 48*c* may be of a thickness, density, materials and other characteristics similar to either of the deep penetrating liner member 48*a* or wide liner member 48*b* types described above. However, the combination liner member 48*c* of FIG. 5C is of a uniquely tailored non-uniform morphology. Thus, a combination jet 28*c* may ultimately be formed such that the perforation tunnel 40*c* which is formed is also of a uniquely tailored morphology.

Accordingly, FIGS. 5A-5C show that altering physical properties (e.g., density) of the liner member 48 adjusts the shape of the resulting jet 28. That is, by altering the explosive component 46, the liner member 48, and/or mass distributions of an axisymmetric shaped charge design, the charge may be converted to an alternate symmetry. It is presently recognized that for cutting control lines, it may be advantageous to use a shaped charge having a planar symmetry, whereby mass is added or removed at pole 180 degrees apart. As a result, during jet collapse, the normally axially uniform fast-moving jet is converted to a slower fan-like geometry that cuts the line spanning multiple degrees from the axis of symmetry which serves to provide increase coverage of the cutter while still achieving velocities and densities inside the cutting fan, which are comparable to linear slot cutters, but which can utilize existing hardware and manufacturing methods.

Figure 6:
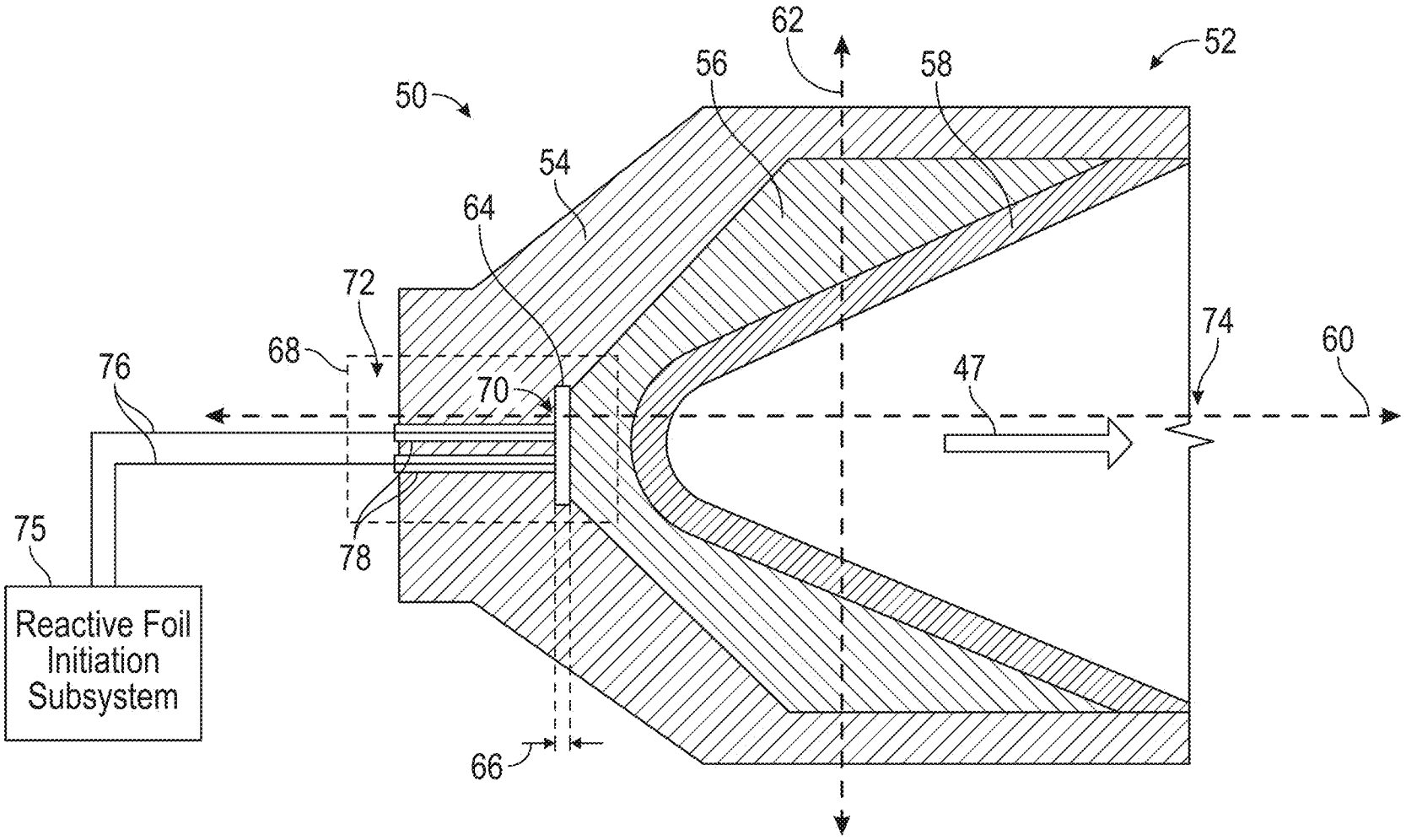
FIG. 6 shows a cross-sectional view of an embodiment of a shaped charge that includes a reactive foil initiation subsystem, in accordance with aspects of the present disclosure.

As described above, aspects of the present disclosure relate to a reactive foil lined shaped charge. By providing a reactive foil as an initiating mechanism for shaped charge (e.g., as opposed to a primer explosive), the shaped charge case of the shaped charge may be made such that it is substantially solid as it extends from the explosive component and to the back of the shaped charge. To illustrate this, FIG. 6 shows a cross-sectional view of a system 50 that includes a reactive foil lined shaped charge 52 (e.g., a shaped charge including one or more reactive foils). The reactive foil lined shaped charge 52 includes a shaped charge case 54 (e.g., a solid-ended shaped charge case, a solid distal end shaped charge case, shaped charge casing member) that holds, encapsulates, or otherwise surrounds (e.g., partially surrounds or fully surrounds) an exterior surface (e.g., relative to the side where the jet may be produced) explosive component 56, and a liner member 58. The shaped charge case 54 may be substantially rigid such that it provides structure for mounting and forming the shape of the explosive component 56. The explosive component 56 may be formed of substantially similar materials as described with reference to the explosive component 46. In addition, the liner member 58 may be formed of substantially similar materials as described with reference to the liner member 48. In some embodiments, the liner member 58 and/or explosive component 56 may have a mass distribution such that they have an axisymmetric symmetry, a planar symmetry, or alternate symmetries depending on the desired jet shape or geometry. Further, it should be noted that the liner member 58 may be coupled to the explosive component 56 using an epoxy or other coupling material to prevent the liner member 58 from decoupling or detaching from the explosive component 56. FIG. 6 illustrates a longitudinal axis 60 and a lateral axis 62 of the reactive foil lined shaped charge 52 to facilitate discussion of the reactive foil lined shaped charge 52. The illustrated embodiment includes a reactive foil 64 positioned between the shaped charge case 54 and the explosive component 56. It should be noted that although only one reactive foil 64 is shown, the reactive foil lined shaped charge 52 may include any suitable number of reactive foils, such as two, three, four, or more than four. Additional details regarding the placement of the reactive foil 64 is described in more detail below.

The reactive foil 64 may be deposited or provided onto an interior surface of the reactive foil lined shaped charge 52 as a relatively thin film or otherwise material layer. For example, the one or more reactive foils 64 may have a thickness 66 less than or equal to about 500 micrometers (μm), 250 μm, 150 μm, 100 μm, or 50 μm. The reactive foil 64 may include one or multiple layers of one or more materials that are capable of undergoing an exothermic reaction (e.g., a self-sustaining exothermic reaction) to initiate the explosive component 56, resulting in detonation of the explosive component 56 and, ultimately, the reactive foil lined shaped charge 52 produces a jet as described with reference to FIGS. 5A-5C. Suitable materials of the reactive foil 64 include, but are not limited to, aluminum-nickel material, an aluminum-titanium material, a titanium-amorphous silicon material, a titanium-boron material, an aluminum-palladium material, or a combination thereof. In an embodiment where the reactive foil 64 includes two or more elements (e.g., the aluminum-nickel material includes aluminum and nickel), each element may be provided as a different layer. The thicknesses of each layer may be the same or different as understood by one of ordinary skill in the art. In any case, the reactive foil 64 may include suitable physical properties (e.g., electrical resistance, impedance, thermal resistance) that control the energy released by the reactive foil 64 and, thus, the velocity of the produced jet. At least in some instances, it may be advantageous to utilize combinations of the thickness 66 with certain physical properties to control the energy released by the reactive foil 64. Accordingly, the reactive foil 64 may be a material that is capable of initiating the explosive component 56.

As described herein, utilizing the reactive foil 64 may prevent or eliminate a loss of tamping mass and pressure that is not used to produce the jet. As such, the shaped charge case 54 may be substantially solid along the axial portion 68, as compared to the shaped charge described with reference to FIG. 4. The axial portion 68 extends from an apex 70 of the explosive component 56 to a first end 72 (e.g., a distal end with respect to the produced jet) of the shaped charge case 54 along the longitudinal axis 60 of the reactive foil lined shaped charge 52. In this way, less pressure is lost through first end 72, and instead is used to produce the jet via the second end 74 (e.g., a proximal end) (e.g., in the direction 47).

The reactive foil lined shaped charge 52 may be coupled to a reactive foil initiation subsystem 75 that includes suitable devices (e.g., triggers, input devices, and so on) to trigger initiation of the reactive foil 64, thereby creating a jet. In some embodiments, the reactive foil initiation subsystem 75 may be wirelessly coupled to the reactive foil 64. As shown, the reactive foil initiation subsystem 75 may be coupled to the reactive foil 64 via multiple wires 76. As such, the axial portion 68 may include holes 78 sized to fit the wires 76. However, in some instances, the holes 78 may be substantially filled with the wires 76 and/or a filler material, thereby preventing the loss of tamping mass and pressure that is not used to produce the jet.

Figure 7:
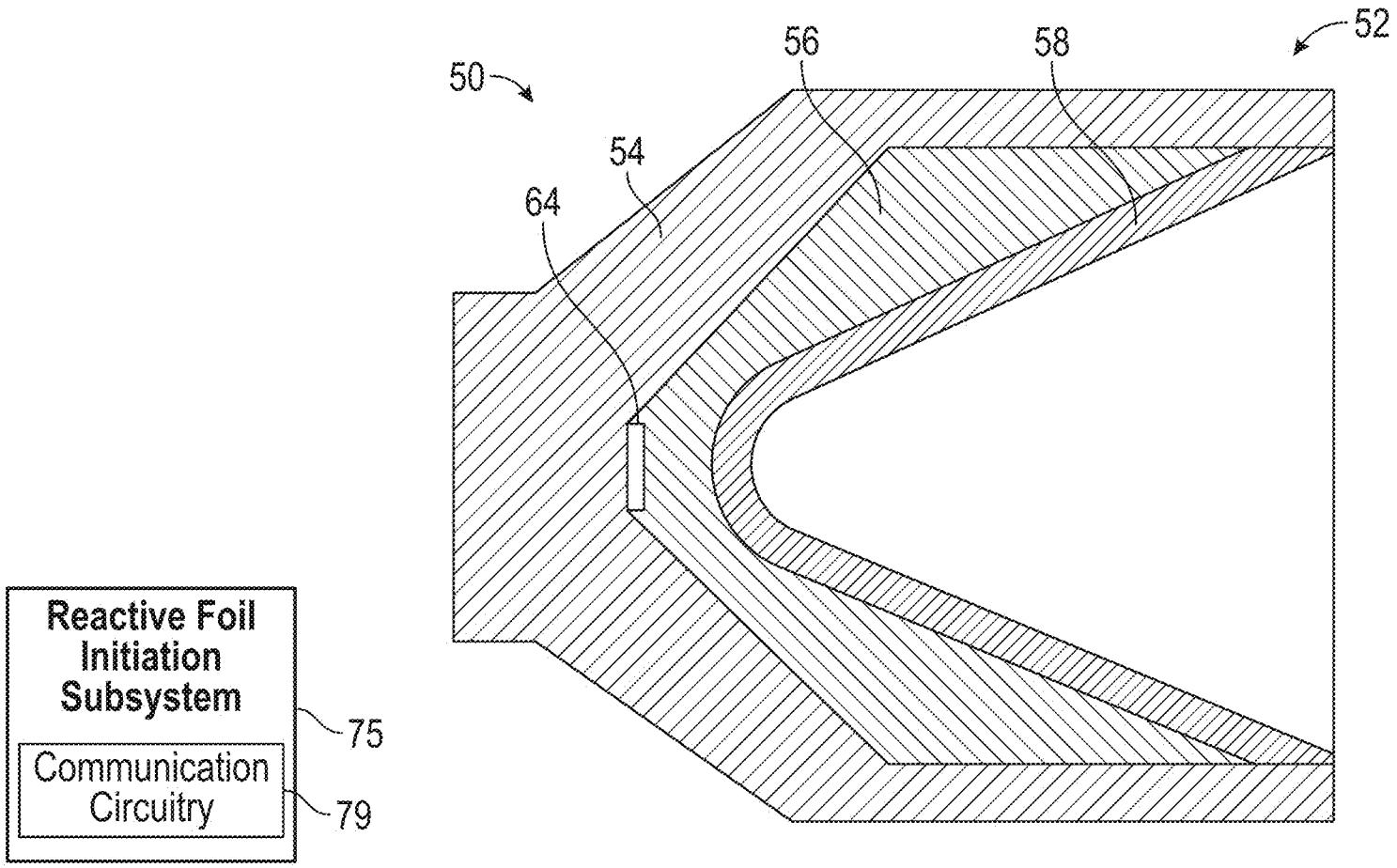
FIG. 7 shows a cross-sectional view of an embodiment of a shaped charge that includes a reactive foil initiation subsystem that detonates the reactive foil wirelessly, in accordance with aspects of the present disclosure.

In some embodiments, the reactive foil 64 may be initiated wirelessly. To illustrate this, FIG. 7 shows a cross-sectional view of the system 50 including the reactive foil lined shaped charge 52 with a reactive foil initiation subsystem 75 that is capable of detonating the reactive foil wirelessly. In the illustrated embodiment, the reactive foil lined shaped charge 52 includes a shaped charge case 54 that holds, encapsulates, or otherwise surrounds an explosive component 56 and a liner member 58. The explosive component 56 may be formed of substantially similar materials as described with reference to the explosive component 46. The liner member 58 may be formed of substantially similar materials as described with reference to the liner member 48.

In the illustrated embodiment, the reactive foil initiation subsystem 75 includes communication circuitry 79. The communication circuitry 79 may be capable of transmitting electromagnetic radiation or acoustic waves capable of heating the reactive foil 64, such as microwaves. In this way, the reactive foil 64 may be initiated remotely and, thus, further eliminate or reduce the use of holes on the shaped charge case 54 as described herein. It should be noted that the reactive foil initiation subsystem 75 may include one or more additional components, such as a processor, memory, input/output devices, and the like, that may aid an operator in communicating wirelessly a trigger to the reactive foils 64.

Figure 8:
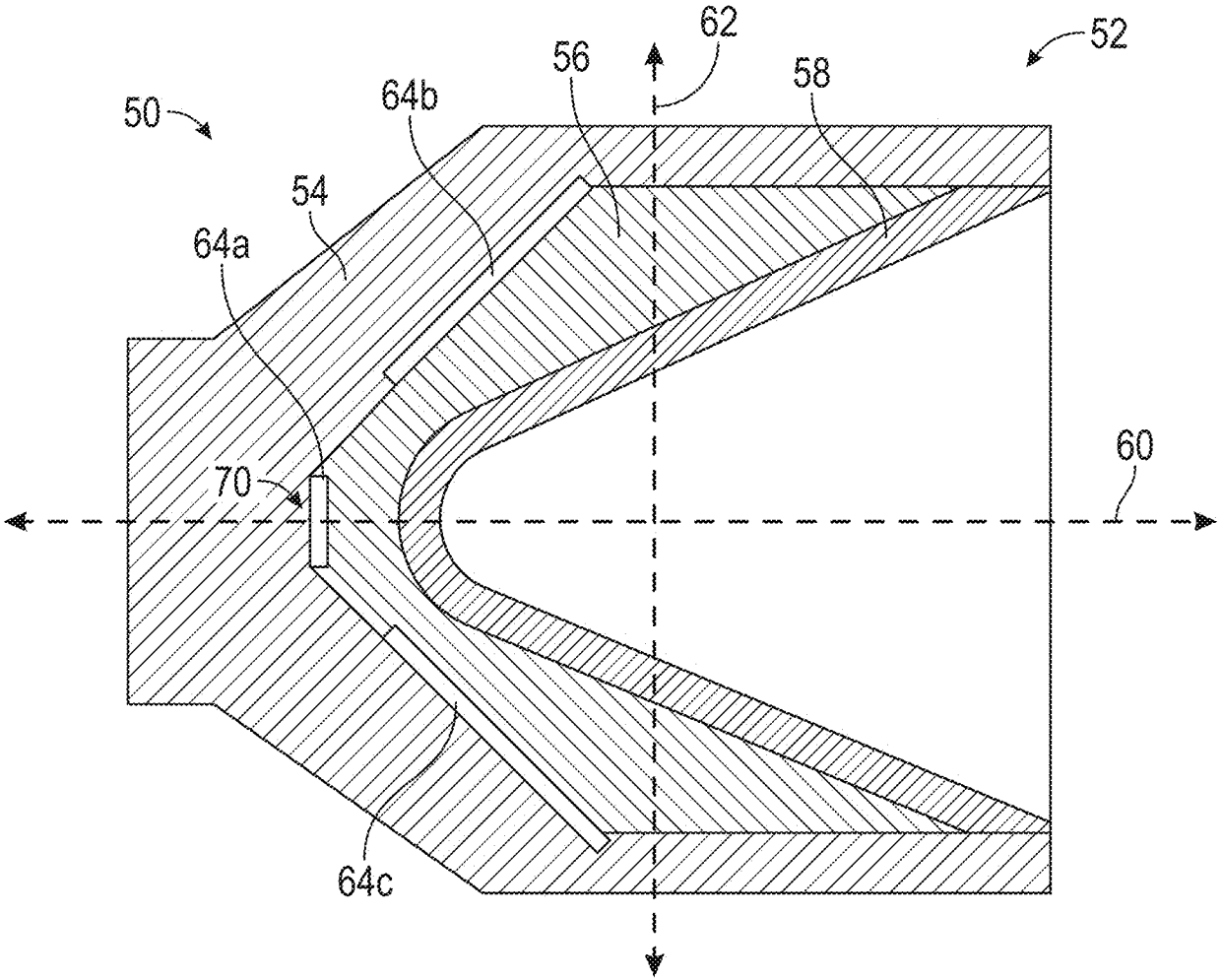
FIG. 8 shows a cross-sectional view of an embodiment of a shaped charge with reactive foils between a shaped charge case and an explosive component, in accordance with aspects of the present disclosure.
Figure 9:
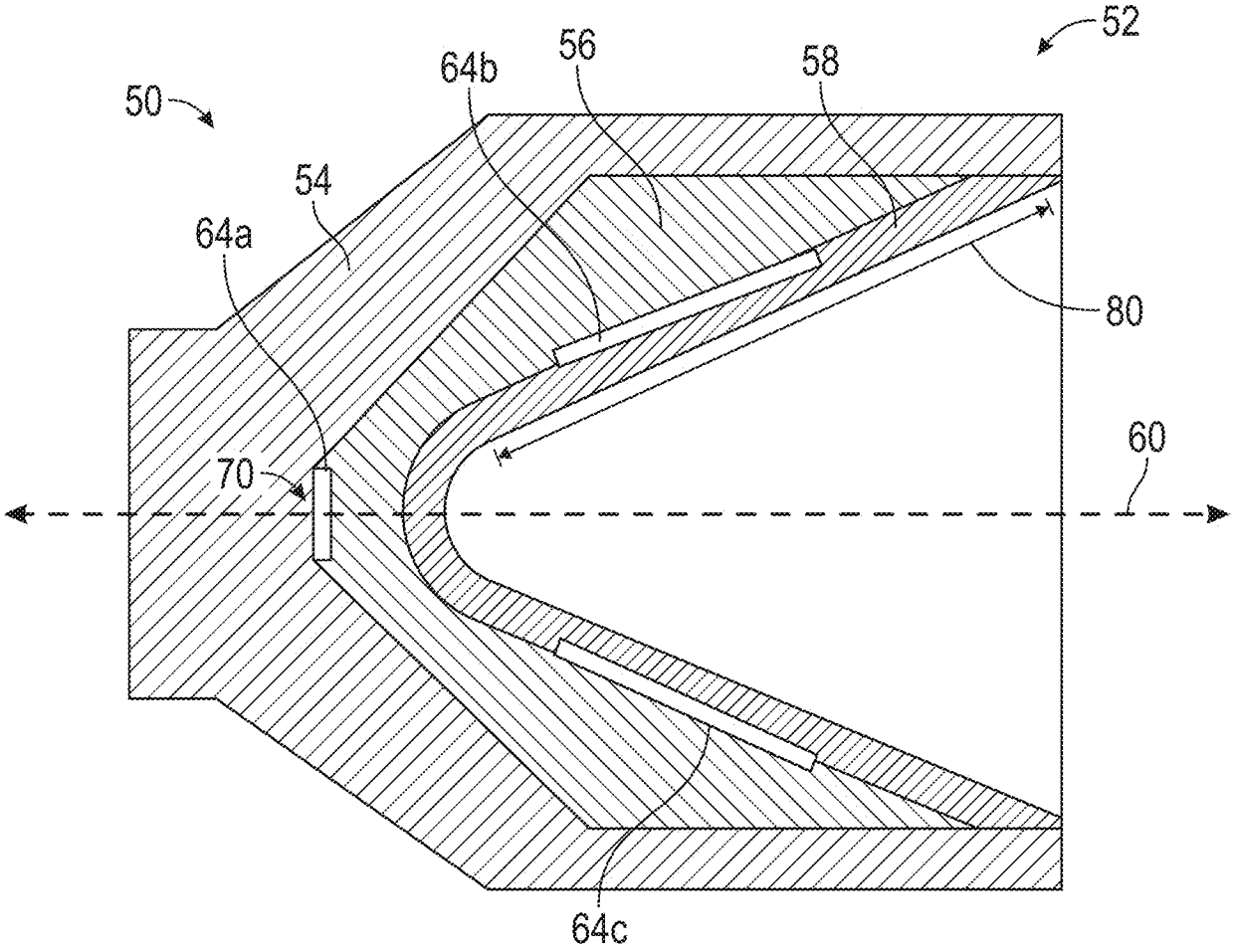
FIG. 9 shows a cross-sectional view of an embodiment of a shaped charge with reactive foils between different components of the shaped charge, in accordance with aspects of the present disclosure.
Figure 10:
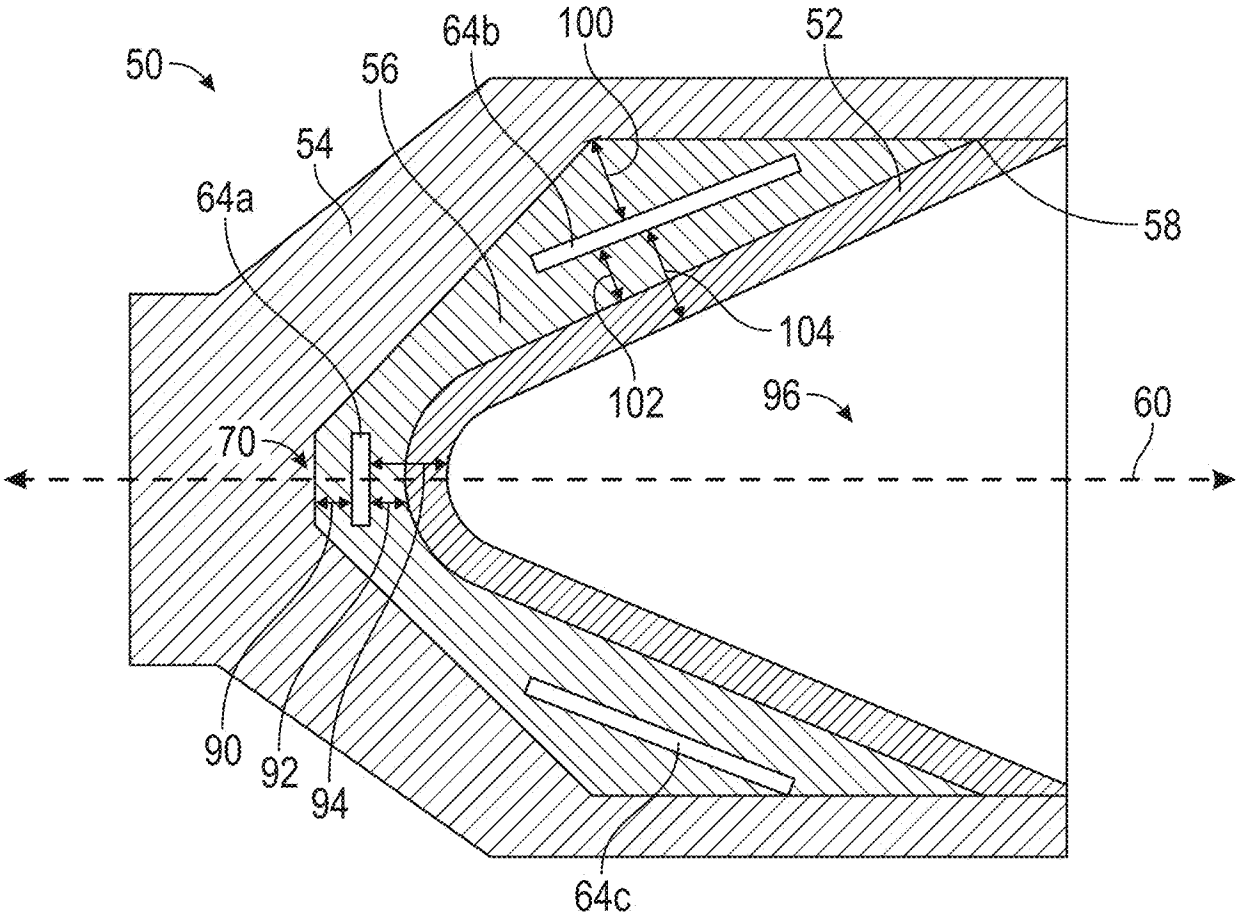
FIG. 10 shows a cross-sectional view of an embodiment of a shaped charge with reactive foils embedded within a component of the shaped charge, in accordance with aspects of the present disclosure.

As described herein, the reactive foil may be disposed on one or more interior surfaces of the shaped charge. FIGS. 8-10 show different configurations for the reactive foils. It should be noted that any of the configurations of FIGS. 8-10 may be detonated with a wiring mechanism (e.g., as described with respect to FIG. 6) and/or wirelessly (e.g., as described with respect to FIG. 7). Furthermore, the configurations shown in FIGS. 8-10 may be used in any combination.

FIG. 8 shows a first example of a system 50 that includes a reactive foil lined shaped charge 52 wherein multiple reactive foils 64 are disposed between the shaped charge case 54 and the explosive component 56. As shown, the reactive foil lined shaped charge 52 includes a first reactive foil 64*a*, a second reactive foil 64*b*, and a third reactive foil 64*c*. It should be noted that although the illustrated embodiment of FIG. 8 includes a liner member 58, the liner member 58 may be omitted in certain implementations.

As shown, the first reactive foil 64*a* (e.g., a primary reactive foil) is disposed at or positioned near an apex 70 (e.g., a first longitudinal position along the longitudinal axis 60) of the reactive foil lined shaped charge 52. Further, the second reactive foil 64*b* and the third reactive foil 64*c* are disposed along lateral locations (e.g., locations along the lateral axis 62) away from the apex 70. The second reactive foil 64*b* and the third reactive foil 64*c* are also disposed at a second longitudinal position along the longitudinal axis 60 that is different from the first longitudinal position corresponding to the first reactive foil 64*a*. The second longitudinal position may be any position between the apex 70 and the second end 74 of the reactive foil lined shaped charge 52. For example, the second longitudinal position may be at a distance from the apex 70 that is about 10%, 25%, 30%, 40%, 50%, 80%, and so on, of the total distance from the apex 70 to the second end 74. It is presently recognized that disposing multiple reactive foils 64 at different positions may facilitate control of the resulting jet. It should be noted that while three reactive foils 64 are shown, the reactive foil lined shaped charge 52 may include any suitable number of reactive foils 64, such as four, five, six, or more. Further, although the second reactive foil 64*b* and the third reactive foil 64*c* are shown as being on opposing sides of the longitudinal axis 60, the reactive foils 64 (e.g., although the second reactive foil 64*b* and the third reactive foil 64*c*) may be radially arranged about the longitudinal axis 60 in any suitable configuration. For example, the reactive foil lined shaped charge 52 may include three reactive foils 64 that are radially offset by 120° about the longitudinal axis, four reactive foils 64 that are radially offset by 90° about the longitudinal axis, and so on.

In some embodiments, the reactive foil 64 may be disposed between the liner member 58 and the explosive component 56. To illustrate this, FIG. 9 shows a second example of the system 50 including the reactive foil lined shaped charge 52 that includes reactive foils 64 disposed between the liner member 58 and the explosive component 56. More specifically, FIG. 9 includes a first reactive foil 64*a*, a second reactive foil 64*b*, and a third reactive foil 64*c*. The first reactive foil 64*a* is disposed at the apex 70. The second reactive foil 64*b* and the third reactive foil 64*c* are disposed between the explosive component 56 and the liner member 58 along lateral locations. As described above with reference to FIG. 8, disposing multiple reactive foils 64 at different positions may facilitate control of the resulting jet.

Further, while three reactive foils 64 are shown, the reactive foil lined shaped charge 52 may include any suitable number of reactive foils 64, such as four, five, six, or more. Additionally, although the second reactive foil 64*b* and the third reactive foil 64*c* are shown as being on opposing sides of the longitudinal axis 60, the reactive foils 64 (e.g., although the second reactive foil 64*b* and the third reactive foil 64*c*) may be radially arranged about the longitudinal axis 60 in any suitable configuration. For example, the reactive foil lined shaped charge 52 may include three reactive foils 64 that are radially offset by 120° about the longitudinal axis, four reactive foils 64 that are radially offset by 90° about the longitudinal axis, and so on.

As shown, the first reactive foil 64*a* is disposed at or positioned near an apex 70 of the reactive foil lined shaped charge 52. Further, the second reactive foil 64*b* and the third reactive foil 64*c* are disposed along lateral locations (e.g., locations along the lateral axis 62) away from the apex 70. In this embodiment, the second reactive foil 64*b* and the third reactive foil 64*c* are disposed along a skirt section 80 of the liner member 58. As described above, the reactive foil lined shaped charge 52 may include additional reactive foils 64. For example, the reactive foil lined shaped charge 52 may include three or more reactive foils 64 radially distributed about the longitudinal axis 60 and coupled to the liner member 58. It should be noted that inducing symmetry of the reactive foils 64 may be useful for controlling the shape and/or velocity of the jet produced by the reactive foil lined shaped charge 52.

In some embodiments, the reactive foils 64 may be disposed or embedded within the explosive component 56 or the liner member 58. To illustrate this, FIG. 10 shows a third example of the system 50 including the reactive foil lined shaped charge 52 wherein the reactive foil 64 is disposed within the explosive component 56. It should be noted that the discussion of FIG. 10 may also be applied to a shaped charge with a reactive foil 64 disposed within the liner member 58. It is presently recognized that the relative positioning of the reactive foil 64 within the explosive component 56 and/or the liner member 58 may affect the velocity and/or shape of the jet produced by the reactive foil lined shaped charge 52.

Three reactive foils (e.g., a first reactive foil 64*a*, a second reactive foil 64*b*, and a third reactive foil 64*c*) are shown in the reactive foil lined shaped charge 52 of FIG. 10. In a similar manner as described above with reference to FIGS. 8 and 9, the reactive foil lined shaped charge 52 may include additional or fewer reactive foils 64.

As shown, the first reactive foil 64*a* is a first distance 90 from the shaped charge case 54 and a second distance 92 from the liner member 58. The first reactive foil 64*a* is a third distance 94 from the inner volume 96 of the reactive foil lined shaped charge 52. The first distance 90, the second distance 92, and the third distance 94 may be sized to any suitable dimensions. In some embodiments, the first distance 90 and the second distance 92 may be equal (or substantially similar). Alternatively, the first distance 90 and the second distance 92 may be different. For example, the first reactive foil 64*a* may be positioned close towards the inner volume 96 than the shaped charge case 54. In any case, adjustment of the first distance 90, the second distance 92, and the third distance 94 may be used to tune the shape and/or velocity of the jet produced by the reactive foil lined shaped charge 52.

As shown, the second reactive foil 64*b* is a first distance 100 from the shaped charge case 54 and a second distance 102 from the liner member 58. The second reactive foil 64*b* is a third distance 104 from the inner volume 96 of the reactive foil lined shaped charge 52. The first distance 100, the second distance 102, and the third distance 104 may be sized to any suitable dimensions. In some embodiments, the first distance 100 and the second distance 102 may be equal (or substantially similar). Alternatively, the first distance 100 and the second distance 102 may be different. For example, the second reactive foil 64*b* may be positioned close towards the inner volume 96 than the shaped charge case 54. In any case, adjustment of the first distance 100, the second distance 102, and the third distance 104 may be used to tune the shape and/or velocity of the jet produced by the reactive foil lined shaped charge 52.

Accordingly, FIGS. 8-10 show examples of relative positioning of the reactive foils 64 within the reactive foil lined shaped charges 52. It should be noted that the reactive foil lined shaped charges 52 may include combinations of the arrangements described above. For example, a reactive foil lined shaped charge 52 may include a reactive foil 64 at the apex 70 that is embedded within the explosive component 56. Further, the reactive foil lined shaped charge 52 may include one or more reactive foils 64 that are disposed along the skirt section 80 or other suitable lateral location within the reactive foil lined shaped charge 52. Further, certain components of the reactive foil lined shaped charge 52 may be omitted. For example, the reactive foil lined shaped charge 52 may not include a liner member 58. Moreover, the system 50 may include the reactive foil lined shaped charge 52 and a reactive foil initiation subsystem 75 that is electrically coupled to the reactive foils 64 via wires or that wirelessly controls initiation.

Figure 11:
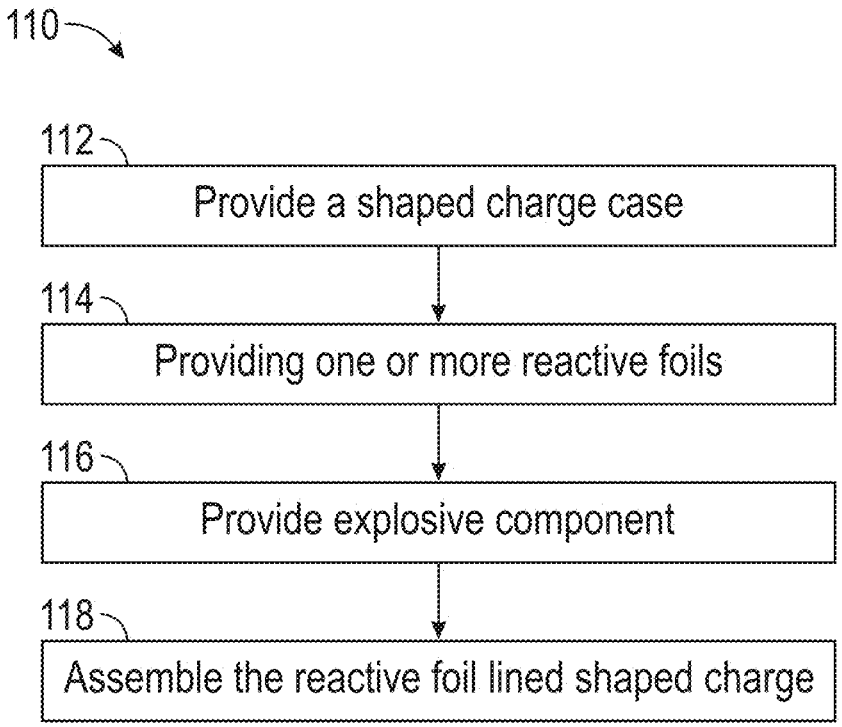
FIG. 11 shows a flow diagram of a method for assembling a shaped charge that includes a reactive foil, in accordance with aspects of the present disclosure.

In any case, as described herein, the disclosed techniques for forming the reactive foil lined shaped charge 52 that provides an initiating mechanism may avoid using a shaped charge case that includes holes which may reduce the velocity of the jet. FIG. 11 shows an example process 110 for forming a reactive foil lined shaped charge 52 in accordance with the present disclosure. As shown, the process 110 includes, at block 112, providing the shaped charge case 54 of the reactive foil lined shaped charge 52. As described herein, the shaped charge case 54 may be substantially solid along the axial portion 68 that extends away from the apex 70 of the explosive component 56. Further, the process 110 includes providing, at block 114, one or more reactive foils 64. As described herein, one or more reactive foils 64 may be utilized in the reactive foil lined shaped charge 52. Further, the relative thicknesses (e.g., the thickness 66) of the reactive foils 64 may vary, which may affect the shape and/or velocity of the jet produced by the reactive foil lined shaped charge 52. For example, it may be advantageous to provide thinner or thicker reactive foils 64 at the apex 70. Referring back to the process 110, at block 116, the process 110 includes providing the explosive component 56 (e.g., one or more explosive materials to form the explosive component). Further still, the process 110 includes, at block 118, assembling the reactive foil lined shaped charge 52. Assembling the reactive foil lined shaped charge 52 may include coupling the reactive foil 64 to the explosive component 56 and/or placing the explosive component 56 within the shaped charge case 54. In some embodiments, assembling the reactive foil lined shaped charge 52 may include positioning the reactive foils 64 between the explosive component 56 and the liner member 58. In some embodiments, assembling the reactive foil lined shaped charge 52 may include positioning a reactive foil 64 at the apex 70 and then providing one or more additional reactive foils 64 at lateral locations as described with reference to FIGS. 8-10. Accordingly, the process 110 provides a method for forming a reactive foil lined shaped charge 52 that may be substantially solid at the first end 72 that is opposite of the second end 74 where the jet is formed or produced. The disclosed techniques may provide increased velocities of jets as compared to traditional techniques and reduce pressure losses as described herein.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function)" or "step for (perform)ing (a function) . . . ", it is intended that such elements are to be interpreted under 35 U.S.C. 112(f). However, for any claims containing elements designated in any other manner, it is intended that such elements are not to be interpreted under 35 U.S.C. 112 (f).

The invention claimed is:

1. A shaped charge, comprising:

an explosive component;

a shaped charge case surrounding an exterior surface of the explosive component;

a liner member coupled to the explosive component, wherein the explosive component and the liner member are configured to form a perforating jet based on detonation of the explosive component; and a plurality of reactive foils coupled to the explosive component and configured to initiate an explosion of the explosive component, wherein the plurality of reactive foils comprises:

a first reactive foil positioned at an apex portion of the shaped charge case at a first longitudinal position along a longitudinal axis of the shaped charge case; and a plurality of second reactive foils positioned along a skirt portion of the shaped charge case at respective second longitudinal positions along the longitudinal axis of the shaped charge case, wherein the first longitudinal position is different from the respective second longitudinal positions.

2. The shaped charge of claim 1, wherein each reactive foil of the plurality of reactive foils comprises a thickness that is less than or equal to 500 micrometers.

3. The shaped charge of claim 1, wherein the plurality of reactive foils comprises an aluminum-nickel material, an aluminum-titanium material, a titanium-amorphous silicon material, a titanium-boron material, an aluminum-palladium material, or a combination thereof.

4. The shaped charge of claim 1, wherein the shaped charge case is substantially solid as the shaped charge case extends from an apex of the explosive component along a longitudinal axis of the explosive component.

5. The shaped charge of claim 1, comprising a reactive foil initiation subsystem configured to trigger the detonation of the explosive component by the plurality of reactive foils.

6. The shaped charge of claim 5, wherein the reactive foil initiation subsystem is configured to trigger the detonation of the explosive component by the plurality of reactive foils via wireless communication.

7. The shaped charge of claim 1, wherein the plurality of reactive foils is embedded within the explosive component.

8. The shaped charge of claim 1, wherein the plurality of reactive foils is positioned along a skirt section of the explosive component.

9. The shaped charge of claim 1, wherein the plurality of reactive foils comprises a first reactive foil and a second reactive foil, wherein the first reactive foil is positioned between the explosive component and the shaped charge case of the shaped charge, and wherein the second reactive foil is positioned between the explosive component and the liner member of the shaped charge.

10. The shaped charge of claim 1, wherein the respective second longitudinal positions are positioned closer to an end of the shaped charge case as compared to the first longitudinal position, and wherein the end corresponds to where the perforating jet is formed.

11. A shaped charge, comprising:

an explosive component;

a shaped charge case surrounding an exterior surface of the explosive component;

a liner member coupled to the explosive component, wherein the explosive component and the liner member are configured to form a perforating jet based on detonation of the explosive component;

a primary reactive foil positioned at an apex of the explosive component at a first longitudinal position along a longitudinal axis of the shaped charge case, wherein the primary reactive foil is configured to initiate the explosive component;

a plurality of additional reactive foils separate from the primary reactive foil and positioned along a skirt portion of the shaped charge case at respective second longitudinal positions along the longitudinal axis of the shaped charge case, wherein the first longitudinal position is different from the second longitudinal positions; and a reactive foil initiation subsystem configured to trigger the detonation of the explosive component by the primary reactive foil and the plurality of additional reactive foils.

12. The shaped charge of claim 11, wherein the plurality of additional reactive foils is disposed between the shaped charge case and the explosive component.

13. The shaped charge of claim 11, wherein the plurality of additional reactive foils is embedded within the explosive component.

14. The shaped charge of claim 11, wherein the shaped charge case is substantially solid as the shaped charge case extends from an apex of the explosive component along a longitudinal axis of the explosive component.

15. The shaped charge of claim 11, wherein the liner member comprises a planar symmetry.

16. The shaped charge of claim 11, wherein the reactive foil initiation subsystem is electrically coupled to the primary reactive foil.

17. The shaped charge of claim 11, wherein the reactive foil initiation subsystem is wirelessly coupled to the primary reactive foil.

18. The shaped charge of claim 11, wherein the plurality of additional reactive foils is disposed between the liner member and the explosive component.

19. A method, comprising:

providing a shaped charge case;

providing one or more reactive foils within an apex portion of the shaped charge case at a first longitudinal position along a longitudinal axis of the shaped charge case;

providing an explosive material into the shaped charge case and coupling the explosive material to the one or more reactive foils;

providing a plurality of additional reactive foils along a skirt portion of the shaped charge case at respective second longitudinal positions along the longitudinal axis of the shaped charge case, wherein the first longitudinal position is different from the second longitudinal positions; and assembling a reactive lined shaped charge based on the explosive material being provided into the shaped charge case and coupled to the one or more reactive foils and the plurality of additional reactive foils.

* * * * *